US010823445B2

(12) United States Patent
Suzuki et al.

(10) Patent No.: US 10,823,445 B2
(45) Date of Patent: Nov. 3, 2020

(54) REFRIGERATION CYCLE APPARATUS

(71) Applicant: Mitsubishi Electric Corporation, Tokyo (JP)

(72) Inventors: Yasuhiro Suzuki, Tokyo (JP); Masahiko Takagi, Tokyo (JP); Kenyu Tanaka, Tokyo (JP); Kazuki Watanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 25 days.

(21) Appl. No.: 16/078,883

(22) PCT Filed: Apr. 27, 2016

(86) PCT No.: PCT/JP2016/063228
§ 371 (c)(1),
(2) Date: Aug. 22, 2018

(87) PCT Pub. No.: WO2017/187562
PCT Pub. Date: Nov. 2, 2017

(65) Prior Publication Data

US 2019/0024931 A1 Jan. 24, 2019

(51) Int. Cl.
*F24F 11/74* (2018.01)
*F24F 11/65* (2018.01)
(Continued)

(52) U.S. Cl.
CPC ..... *F24F 11/74* (2018.01); *F24F 1/0003* (2013.01); *F24F 1/005* (2019.02); *F24F 11/36* (2018.01);
(Continued)

(58) Field of Classification Search
None
See application file for complete search history.

(56) References Cited

U.S. PATENT DOCUMENTS 5,720,176 A * 2/1998 Manson ..... H01H 9/0235 62/89
5,761,908 A * 6/1998 Oas ..... F24F 12/006 62/3.2
(Continued)

FOREIGN PATENT DOCUMENTS

JP 2001-235212 A 8/2001
JP 2001-1235212 A 8/2001
(Continued)

OTHER PUBLICATIONS

Extended European Search Report dated Mar. 14, 2019 issued in corresponding EP patent application No. 16900434.8.
(Continued)

*Primary Examiner* — Nelson J Nieves
(74) *Attorney, Agent, or Firm* — Posz Law Group, PLC

(57) ABSTRACT

A refrigeration cycle apparatus according to the present invention, a controller is configured to cause a first operation mode and a second operation mode to be executed as operation modes of an air-sending fan. The first operation mode is an operation mode in which an operation of the air-sending fan is started based on a first manipulation performed on an operation unit and the air-sending fan is stopped based on a second manipulation performed on the operation unit. The second operation mode is an operation mode in which the operation of the air-sending fan is started when refrigerant is detected by a refrigerant detection unit, the air-sending fan is not stopped based on the second manipulation, the air-sending fan is stopped based on a third manipulation different from the second manipulation, and the operation of the air-sending fan is restarted based on a fourth manipulation different from the first manipulation.

10 Claims, 7 Drawing Sheets

(51) Int. Cl.

| | |
|---|---|
| ***F24F 11/61*** | (2018.01) |
| ***F24F 11/72*** | (2018.01) |
| ***F24F 11/50*** | (2018.01) |
| ***F25B 13/00*** | (2006.01) |
| ***F24F 11/89*** | (2018.01) |
| ***F25B 49/02*** | (2006.01) |
| ***F24F 1/005*** | (2019.01) |
| ***F24F 1/0003*** | (2019.01) |
| ***F24F 11/36*** | (2018.01) |
| ***F25B 9/00*** | (2006.01) |
| ***F25B 41/06*** | (2006.01) |

(52) U.S. Cl.

CPC ..... *F24F 11/50* (2018.01); *F24F 11/61* (2018.01); *F24F 11/65* (2018.01); *F24F 11/72* (2018.01); *F24F 11/89* (2018.01); *F25B 9/002* (2013.01); *F25B 13/00* (2013.01); *F25B 41/062* (2013.01); *F25B 49/02* (2013.01); *F24F 2221/54* (2013.01); *F25B 2313/0293* (2013.01); *F25B 2313/02741* (2013.01); *F25B 2500/222* (2013.01); *F25B 2600/01* (2013.01); *F25B 2600/2513* (2013.01); *F25B 2700/1931* (2013.01)

(56) References Cited

U.S. PATENT DOCUMENTS

| | | | | |
|---|---|---|---|---|
| 7,079,040 | B2 * | 7/2006 | Barton | F24F 11/30 340/657 |
| 2002/0178738 | A1 * | 12/2002 | Taira | F25B 49/005 62/129 |
| 2004/0130454 | A1 * | 7/2004 | Barton | F24F 11/30 340/657 |
| 2006/0201043 | A1 * | 9/2006 | Kim | F24F 1/0007 40/725 |
| 2011/0084805 | A1 * | 4/2011 | Matsumoto | G08C 17/02 340/10.1 |
| 2013/0255909 | A1 * | 10/2013 | Matsumoto | F28F 27/00 165/11.1 |
| 2015/0219350 | A1 * | 8/2015 | Gumaer | F24F 11/77 454/343 |
| 2016/0146521 | A1 * | 5/2016 | Tomita | F25B 49/022 62/126 |
| 2016/0245566 | A1 * | 8/2016 | Hiraki | F25B 49/005 |
| 2016/0348933 | A1 * | 12/2016 | Takeuchi | F24F 1/50 |
| 2017/0198936 | A1 * | 7/2017 | Yamaguchi | F24F 11/74 |
| 2017/0321940 | A1 * | 11/2017 | Ikawa | F24F 11/89 |
| 2017/0350614 | A1 * | 12/2017 | Nagaoka | F24F 11/74 |
| 2018/0045424 | A1 * | 2/2018 | Yajima | F25B 49/02 |
| 2018/0135878 | A1 * | 5/2018 | Iura | F24F 7/007 |
| 2018/0283718 | A1 * | 10/2018 | Honda | F25B 13/00 |
| 2018/0283719 | A1 * | 10/2018 | Honda | F24F 11/36 |

FOREIGN PATENT DOCUMENTS

| | | |
|---|---|---|
| JP | 2005-257228 A | 9/2005 |
| JP | 5812081 B2 | 11/2015 |

OTHER PUBLICATIONS

International Search Report dated Jul. 19, 2016 issued in corresponding international patent application No. PCT/JP2016/063228.
Office action dated May 30, 2017 issued in corresponding JP patent application No. 2017-508698 (and English translation thereof).
Office action dated Oct. 10, 2017 issued in corresponding JP patent application No. 2017-508698 (and English translation thereof).
Office Action dated Mar. 10, 2020 issued in corresponding CN patent application No. 201680084811.1 (and English tanslation).

* cited by examiner

REFRIGERATION CYCLE APPARATUS

CROSS REFERENCE TO RELATED APPLICATION

This application is a U.S. national stage application of PCT/JP2016/063228 filed on Apr. 27, 2016, the contents of which are incorporated herein by reference.

TECHNICAL FIELD

The present invention relates to a refrigeration cycle apparatus including an air-sending fan.

BACKGROUND ART

In Patent Literature 1, there is described an indoor unit of an air-conditioning apparatus. This indoor unit includes a refrigerant detection unit configured to detect leakage of refrigerant, a controller configured to perform, when the refrigerant detection unit detects leakage of the refrigerant, control for causing an air-sending fan to forcedly rotate and causing a warning device to issue a warning, and an operation device for inputting, to the controller, a stop command for the air-sending fan and the warning device based on a manual operation of the operation unit. In this indoor unit, after issuance of a warning was started once, sound output (buzzer) output from the warning device can be stopped by manipulations on the operation device performed by a user even before a service person arrives and performs inspection and repair. Therefore, a cause of noise that bothers its vicinities can be eliminated, with the result that dissatisfaction of the user can be get rid of.

CITATION LIST

Patent Literature

Patent Literature 1: Japanese Patent No. 5812081

SUMMARY OF INVENTION

Technical Problem

When the service person arrives and starts the inspection and repair of the air-conditioning apparatus, the air-sending fan is required to be temporarily stopped for the inspection and repair in some cases. However, in Patent Literature 1, there is no description on whether or not the air-sending fan can be temporarily stopped.

Further, depending on the details of a repair in accordance with each occurrence of failure of the air-conditioning apparatus, in some cases, there is no other choice but to take temporary measures for the time being and temporarily leave the site of the inspection and repair, and then take permanent measures (for example, a case in which repair parts are required to be prepared anew as a result of the inspection). In such a case, when the service person leaves the site of the inspection and repair, the air-sending fan is required to be operated again so that a refrigerant concentration is not increased locally. However, in Patent Literature 1, there is no description on whether or not the operation of the air-sending fan of the indoor unit can be started again after being temporarily stopped. Moreover, in general, the air-conditioning apparatus includes three operation modes, namely, a cooling mode, a heating mode, and an air-sending mode, and hence it is possible to perform the operation of the air-sending fan in the air-sending mode by manipulating a remote controller serving as the operation device. However, the operation of the air-sending fan in the air-sending mode can be disadvantageously stopped through a manipulation of the remote controller performed by the user or another person. Accordingly, the user or another person who does not know the cause of leakage and how the inspection and repair was performed may stop the operation of the air-sending fan through the manipulation of the remote controller on his or her own judgment. As a result, there may be a place at which a concentration of refrigerant that has leaked is increased locally in an indoor space.

The present invention has been made in view of the above-mentioned problems, and it is an object of the present invention to provide a refrigeration cycle apparatus capable of inhibiting a refrigerant concentration of refrigerant that has leaked from increasing locally.

Solution to Problem

According to one embodiment of the present invention, there is provided a refrigeration cycle apparatus including: a refrigerant circuit configured to circulate refrigerant; an indoor unit configured to accommodate at least a load-side heat exchanger of the refrigerant circuit; a controller configured to control the indoor unit; and an operation unit configured to receive a manipulation on the indoor unit, the indoor unit including: a refrigerant detection unit; and an air-sending fan, the controller being configured to cause a first operation mode and a second operation mode to be executed as operation modes of the air-sending fan, the first operation mode being an operation mode in which an operation of the air-sending fan is started based on a first operation performed on the operation unit and the air-sending fan is stopped based on a second operation performed on the operation unit, the second operation mode being an operation mode in which the operation of the air-sending fan is started when refrigerant is detected by the refrigerant detection unit, the air-sending fan is prevented from being stopped based on the second manipulation, the air-sending fan is stopped based on a third manipulation different from the second manipulation, and the operation of the air-sending fan is restarted based on a fourth manipulation different from the first manipulation.

Advantageous Effects of Invention

In the refrigeration cycle apparatus according to one embodiment of the present invention, the operation of the air-sending fan is started when refrigerant is detected by the refrigerant detection unit, the air-sending fan is stopped based on the third operation different from the second operation, and the operation of the air-sending fan is restarted based on the fourth manipulation different from the first manipulation. In this manner, it is possible to inhibit the refrigerant concentration of the refrigerant that has leaked from increasing locally.

DESCRIPTION OF EMBODIMENTS

Embodiment

Figure 1:
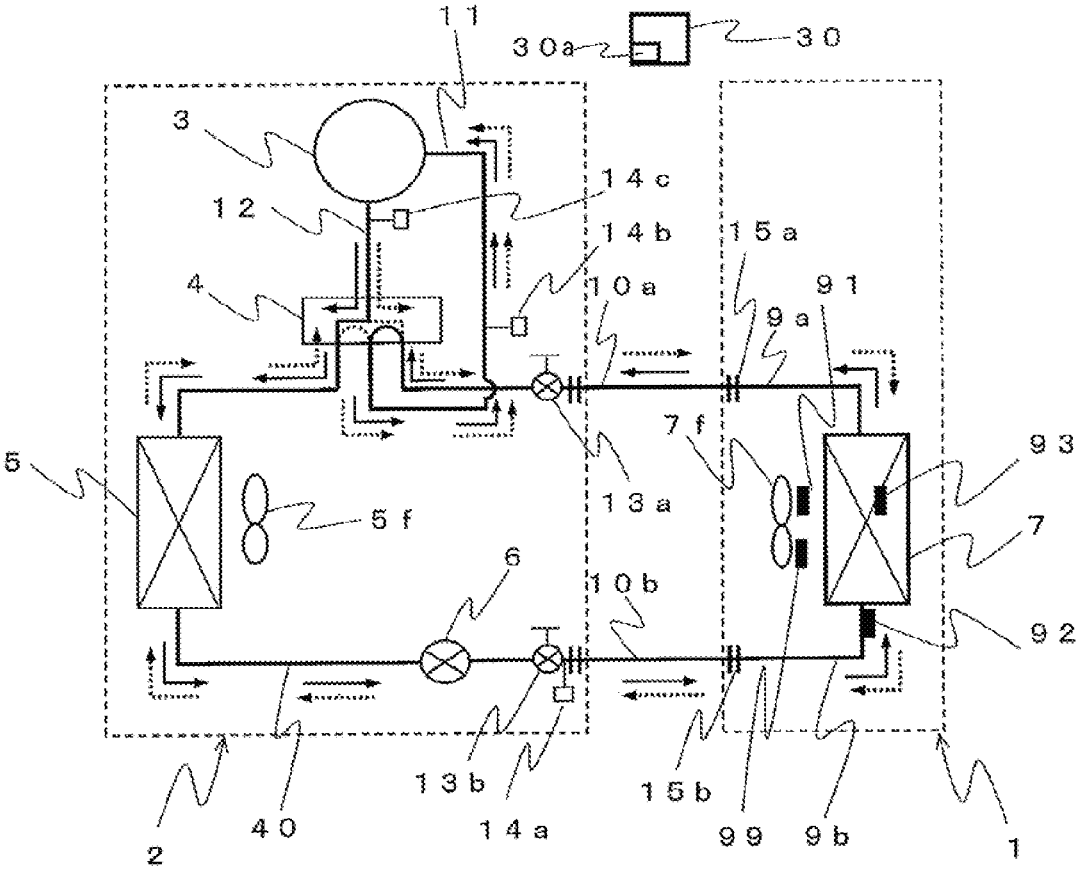
FIG. 1 is a refrigerant circuit diagram for illustrating a schematic configuration of an air-conditioning apparatus in an embodiment of the present invention.

A refrigeration cycle apparatus according to an embodiment of the present invention is described. In this embodiment, an air-conditioning apparatus is exemplified as the refrigeration cycle apparatus. FIG. 1 is a refrigerant circuit diagram for illustrating a schematic configuration of the air-conditioning apparatus in the embodiment of the present invention. In FIG. 1 and the subsequent figures, each component may have a dimensional relationship, a shape, and the like that are different from actual ones.

As illustrated in FIG. 1, the air-conditioning apparatus includes a refrigerant circuit 40 configured to circulate refrigerant. The refrigerant circuit 40 includes a compressor 3, a refrigerant flow switching device 4, a heat source-side heat exchanger 5 (for example, outdoor heat exchanger), a pressure reducing device 6, and a load-side heat exchanger 7 (for example, indoor heat exchanger), which are sequentially connected to form a circuit through refrigerant pipes. Further, the air-conditioning apparatus includes an outdoor unit 2, which is installed, for example, outdoors as a heat source unit. Further, the air-conditioning apparatus includes an indoor unit 1, which is installed, for example, indoors as a load unit. The indoor unit 1 and the outdoor unit 2 are connected to each other through extension pipes 10*a* and 10*b* forming parts of the refrigerant pipes.

Examples of a refrigerant to be used as the refrigerant to be circulated by the refrigerant circuit 40 include a slightly flammable refrigerant such as HFO-1234yf or HFO-1234ze and a strongly flammable refrigerant such as R290 or R1270. Each of those refrigerants may be used as a single-component refrigerant, or may be used as a mixed refrigerant obtained by mixing two or more kinds of the refrigerants with each other. In the following description, the refrigerant having a flammability equal to or higher than a slightly flammable level (for example, 2 L or higher in category of ASHRAE34) is often referred to as "flammable refrigerant". Further, as the refrigerant to be circulated by the refrigerant circuit 40, a nonflammable refrigerant having a nonflammability (for example, 1 in category of ASHRAE34), such as R22 or R410A, can be used. Those refrigerants have a density larger than that of air under an atmospheric pressure (for example, the temperature is room temperature (25 degrees C.)).

The compressor 3 is a fluid machine configured to compress a sucked low-pressure refrigerant and to discharge the low-pressure refrigerant as high-pressure refrigerant. The refrigerant flow switching device 4 is configured to switch a flow direction of the refrigerant within the refrigerant circuit 40 between a cooling operation and a heating operation. As the refrigerant flow switching device 4, for example, a four-way valve is used. The heat source-side heat exchanger 5 is a heat exchanger configured to function as a radiator (for example, condenser) in the cooling operation and to function as an evaporator in the heating operation. The heat source-side heat exchanger 5 exchanges heat between the refrigerant circulated through an inside of the heat source-side heat exchanger 5 and outdoor air sent by an outdoor air-sending fan 5*f* to be described later. The pressure reducing device 6 is configured to reduce the pressure of the high-pressure refrigerant such that the high-pressure refrigerant becomes the low-pressure refrigerant. As the pressure reducing device 6, for example, an electronic expansion valve capable of adjusting its opening degree is used. The load-side heat exchanger 7 is a heat exchanger configured to function as an evaporator in the cooling operation and to function as a radiator (for example, condenser) in the heating operation. The load-side heat exchanger 7 exchanges heat between the refrigerant circulated through an inside of the load-side heat exchanger 7 and air sent by an indoor air-sending fan 7*f* to be described later. In this case, the cooling operation represents an operation for supplying low-temperature and low-pressure refrigerant to the load-side heat exchanger 7, and the heating operation represents an operation for supplying high-temperature and high-pressure refrigerant to the load-side heat exchanger 7.

The outdoor unit 2 accommodates the compressor 3, the refrigerant flow switching device 4, the heat source-side heat exchanger 5, and the pressure reducing device 6. Further, the outdoor unit 2 accommodates the outdoor air-sending fan 5*f* configured to supply outdoor air to the heat source-side heat exchanger 5. The outdoor air-sending fan 5*f* is installed so as to be opposed to the heat source-side heat exchanger 5. When the outdoor air-sending fan 5*f* is rotated, an airflow passing through the heat source-side heat exchanger 5 is generated. As the outdoor air-sending fan 5*f*, for example, a propeller fan is used. The outdoor air-sending fan 5*f* is arranged on, for example, downstream of the heat source-side heat exchanger 5 along the airflow generated by the outdoor air-sending fan 5*f*.

The refrigerant pipes arranged in the outdoor unit 2 include a refrigerant pipe configured to connect between an extension pipe connection valve 13*a* on a side at which the refrigerant becomes a gas phase in the cooling operation (hereinafter referred to as the "gas side" and the refrigerant flow switching device 4, a suction pipe 11 connected to a suction side of the compressor 3, a discharge pipe 12 connected to a discharge side of the compressor 3, a refrigerant pipe configured to connect between the refrigerant flow switching device 4 and the heat source-side heat exchanger 5, a refrigerant pipe configured to connect between the heat source-side heat exchanger 5 and the pressure reducing device 6, and a refrigerant pipe configured to connect between an extension pipe connection valve 13*b* on a side at which the refrigerant becomes a liquid phase in the cooling operation (hereinafter referred to as the "liquid side" and the pressure reducing device 6. The extension pipe connection valve 13*a* includes a two-way valve capable of switching between open and close, and has one end to which a flare joint is mounted. Further, the extension pipe connection valve 13*b* includes a three-way valve capable of switching between open and close. The extension pipe connection valve 13*b* has one end to which a service port 14*a* is mounted, which is used at a time of vacuuming being a preliminary work of filling the refrigerant circuit 40 with refrigerant, and the other end to which a flare joint is mounted.

In both the cooling operation and the heating operation, high-temperature and high-pressure gas refrigerant compressed by the compressor 3 flows through the discharge pipe 12. In both the cooling operation and the heating operation, low-temperature and low-pressure gas refrigerant or two-phase refrigerant subjected to an evaporation action flows through the suction pipe 11. The suction pipe 11 is connected to a low-pressure-side service port 14*b* with a flare joint, and the discharge pipe 12 is connected to a high-pressure-side service port 14*c* with a flare joint. The service ports 14*b* and 14*c* are used to connect a pressure gauge thereto to measure the operating pressure at a time of installation of the air-conditioning apparatus or at a time of a trial run for a repair.

The indoor unit 1 has, in its inside, at least the load-side heat exchanger 7 (for example, indoor heat exchanger), the indoor air-sending fan 7*f* configured to supply air to the load-side heat exchanger 7, joint portions 15*a* and 15*b*, and a refrigerant detection unit 99. Those components are provided inside an air passage of a casing 111 to be described later. When the indoor air-sending fan 7*f* is rotated, an airflow passing through the load-side heat exchanger 7 is generated. As the indoor air-sending fan 7*f*, a centrifugal fan (for example, sirocco fan or turbofan), a cross flow fan, a mixed flow fan, an axial fan (for example, propeller fan), or other fans is used depending on a shape of the indoor unit 1. The indoor air-sending fan 7*f* in this embodiment is arranged on upstream of the load-side heat exchanger 7 along the airflow generated by the indoor air-sending fan 7*f*, but may be arranged on downstream of the load-side heat exchanger 7.

Of the refrigerant pipes of the indoor unit 1, a gas-side indoor pipe 9*a* is provided in a connection portion to the gas-side extension pipe 10*a* with a joint portion 15*a* (for example, flare joint) for connection to the extension pipe 10*a*. Further, of the refrigerant pipes of the indoor unit 1, a liquid-side indoor pipe 9*b* is provided in a connection portion to the liquid-side extension pipe 10*b* with a joint portion 15*b* (for example, flare joint) for connection to the extension pipe 10*b*.

Further, the indoor unit 1 includes a suction air temperature sensor 91 configured to detect a temperature of indoor air sucked from the indoors, a heat exchanger entrance temperature sensor 92 configured to detect a refrigerant temperature at an entrance portion of the load-side heat exchanger 7 in the cooling operation (exit portion of the load-side heat exchanger 7 in the heating operation), and a heat exchanger temperature sensor 93 configured to detect a refrigerant temperature (evaporating temperature or condensing temperature) of a two-phase portion of the load-side heat exchanger 7. In addition, the indoor unit 1 includes a refrigerant detection unit 99 (for example, semiconductor gas sensor) to be described later. Those sensors are configured to output a detection signal to a controller 30 configured to control an entirety of the indoor unit 1 or the air-conditioning apparatus.

The controller 30 includes a microcomputer including a CPU, a ROM, a RAM, an I/O port, and a timer. Further, the controller 30 also includes a clock unit 30*a* configured to clock operation time of the indoor air-sending fan 7*f*, which is to be described later. The controller 30 can conduct data communications to/from an operation unit 26 (see FIGS. 2A and 2B). The operation unit 26 is configured to receive manipulation performed by a user to output to the controller 30 an operation signal based on the manipulation. The controller 30 in this embodiment controls the operation of the entirety of the indoor unit 1 or the air-conditioning apparatus including an operation of the indoor air-sending fan 7*f* based on an operation signal received from the operation unit 26, detection signals received from the sensors, or other signals. Further, the controller 30 in this embodiment can conduct switching between energization and non-energization to the refrigerant detection unit 99. The controller 30 may be provided inside a casing of the indoor unit 1, or may be provided inside a casing of the outdoor unit 2. Further, the controller 30 may include an outdoor unit controller provided to the outdoor unit 2 and an indoor unit controller that is provided to the indoor unit 1 and capable of conducting data communications to/from the outdoor unit controller.

Next, description is given of the operation of the refrigerant circuit 40 of the air-conditioning apparatus. First, the operation in the cooling operation is described. In FIG. 1, the solid arrows indicate flow directions of the refrigerant in the cooling operation. The refrigerant circuit 40 is configured so that, in the cooling operation, a refrigerant flow passage is switched as indicated by the solid line by the refrigerant flow switching device 4 and the low-temperature and low-pressure refrigerant flows into the load-side heat exchanger 7.

The high-temperature and high-pressure gas refrigerant discharged from the compressor 3 first flows into the heat source-side heat exchanger 5 after passing through the refrigerant flow switching device 4. In the cooling operation, the heat source-side heat exchanger 5 functions as a condenser. That is, the heat source-side heat exchanger 5 exchanges heat between the refrigerant circulated through the inside and the outdoor air sent by the outdoor air-sending fan 5*f*, and heat of condensation of the refrigerant is transferred to the outdoor air. With this operation, the refrigerant that has flowed into the heat source-side heat exchanger 5 is condensed to become high-pressure liquid refrigerant. The high-pressure liquid refrigerant flows into the pressure reducing device 6, and has the pressure reduced to become low-pressure two-phase refrigerant. The low-pressure two-phase refrigerant passes through the extension pipe 10*b*, and flows into the load-side heat exchanger 7 of the indoor unit 1. In the cooling operation, the load-side heat exchanger 7 functions as an evaporator. That is, the load-side heat exchanger 7 exchanges heat between the refrigerant circulated through the inside and the air (for example, indoor air) sent by the indoor air-sending fan 7*f*, and heat of evaporation of the refrigerant is received from the sent air. With this operation, the refrigerant that has flowed into the load-side heat exchanger 7 evaporates to become low-pressure gas refrigerant or two-phase refrigerant with high quality. Further, the air sent by the indoor air-sending fan 7*f* is cooled by a heat receiving action of the refrigerant. The low-pressure gas refrigerant or two-phase refrigerant with high quality evaporated by the load-side heat exchanger 7 passes through the extension pipe 10*a* and the refrigerant flow switching device 4, and is sucked by the compressor 3. The refrigerant sucked by the compressor 3 is compressed to become the high-temperature and high-pressure gas refrigerant. In the cooling operation, the above-mentioned cycle is repeated.

Next, the operation in the heating operation is described. In FIG. 1, the dotted arrows indicate flow directions of the refrigerant in the heating operation. The refrigerant circuit 40 is configured so that, in the heating operation, the refrigerant flow passage is switched as indicated by the dotted line by the refrigerant flow switching device 4, and the high-temperature and high-pressure refrigerant flows into the load-side heat exchanger 7. In the heating operation, the refrigerant flows in a direction reverse to that of the cooling operation, and the load-side heat exchanger 7 functions as a condenser. That is, the load-side heat exchanger 7 exchanges heat between the refrigerant circulated through the inside and the air sent by the indoor air-sending fan 7*f*, and the heat of condensation of the refrigerant is transferred to the sent air. With this operation, the air sent by the indoor air-sending fan 7*f* is heated by a heat transferring action of the refrigerant.

Figure 2A:
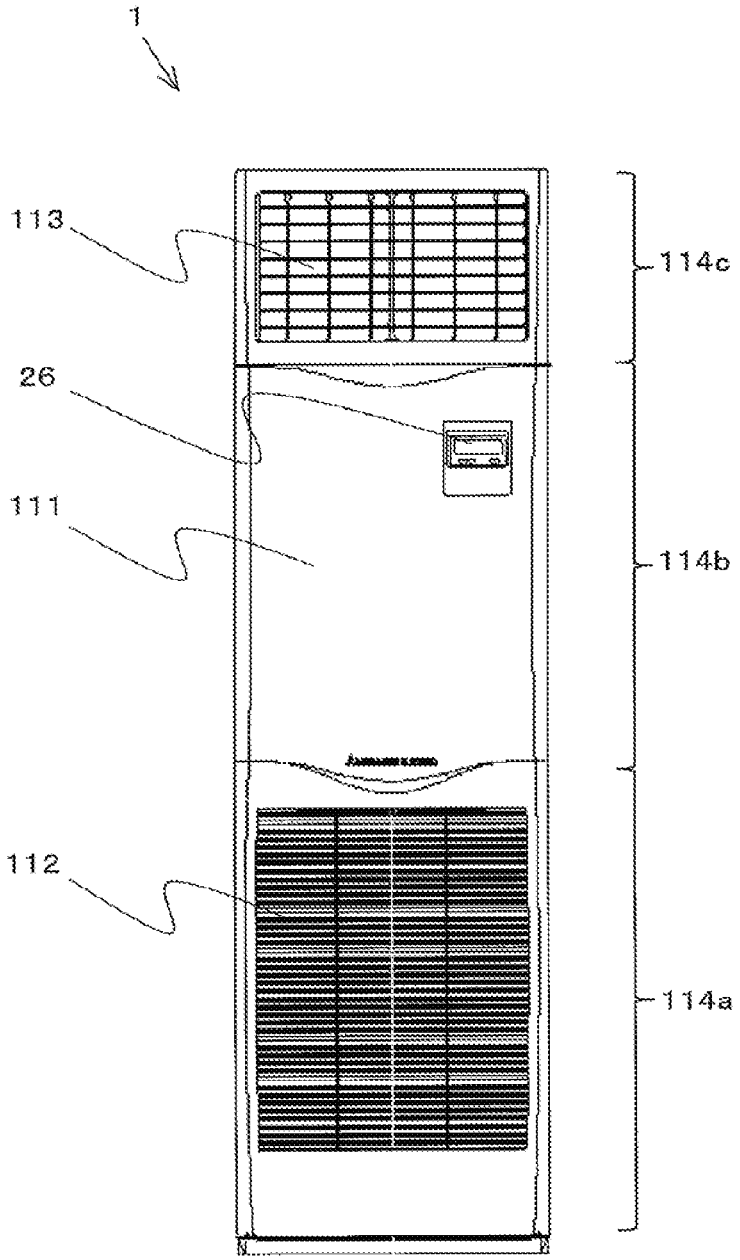
FIG. 2A is a front view for illustrating a configuration of an exterior of an indoor unit 1 of the air-conditioning apparatus in the embodiment of the present invention.
Figure 2B:
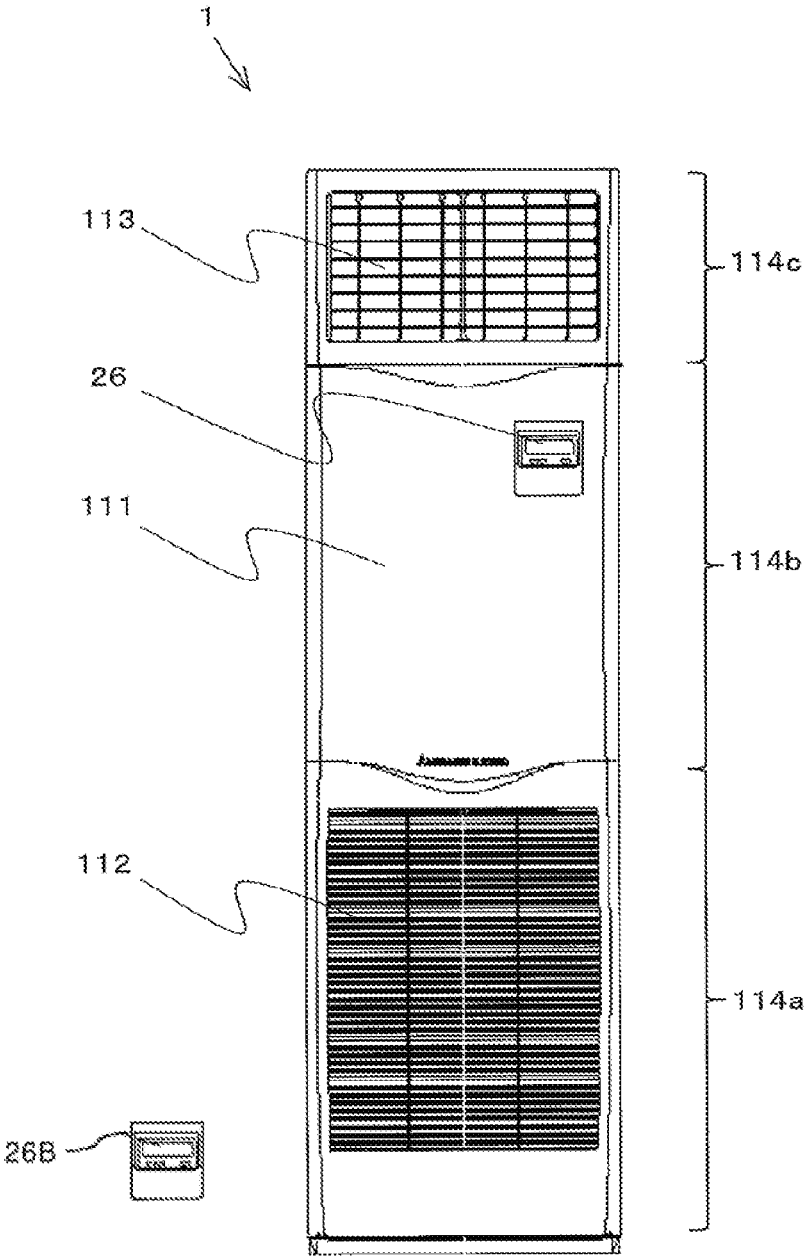
FIG. 2B is a front view for illustrating a configuration of an exterior of an indoor unit 1 of the air-conditioning apparatus in the embodiment of the present invention.
Figure 3:
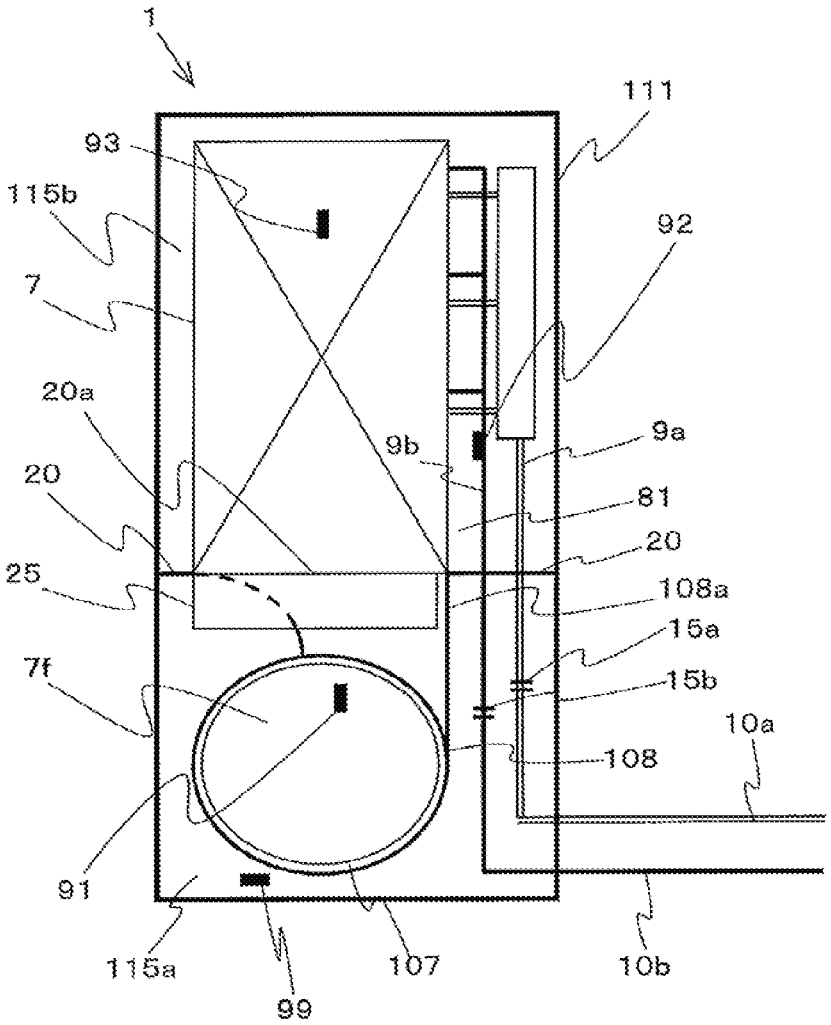
FIG. 3 is a front view for schematically illustrating an internal structure of the indoor unit 1 of the air-conditioning apparatus in the embodiment of the present invention.
Figure 4:
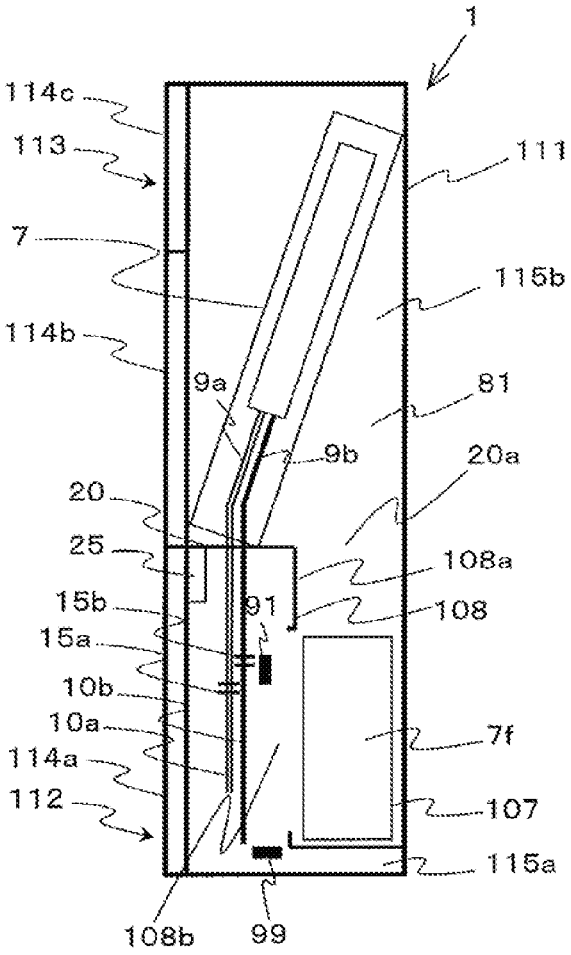
FIG. 4 is a side view for schematically illustrating the internal structure of the indoor unit 1 of the air-conditioning apparatus in the embodiment of the present invention.

FIGS. 2A and 2B are a front view for illustrating a configuration of an exterior of the indoor unit 1 of the air-conditioning apparatus in the embodiment of the present invention. FIG. 3 is a front view for schematically illustrating an internal structure of the indoor unit 1 of the air-conditioning apparatus in the embodiment of the present invention. FIG. 4 is a side view for schematically illustrating the internal structure of the indoor unit 1 of the air-conditioning apparatus in the embodiment of the present invention. The left of FIG. 4 indicates a front surface side (indoor space side) of the indoor unit 1. In this embodiment, as the indoor unit 1, the indoor unit 1 of a floor type, which is installed on a floor surface of an indoor space being an air-conditioned space, is described as an example. In the following description, positional relationships (for example, top-bottom relationship) between components are, in principle, exhibited when the indoor unit 1 is installed in a usable state.

As illustrated in FIG. 2 to FIG. 4, the indoor unit 1 includes a casing 111 having a longitudinally cuboid shape. An air inlet 112 configured to suck air inside the indoor space is formed in a lower portion of a front surface of the casing 111. The air inlet 112 in this embodiment is provided in a position proximate to the floor surface below a center portion of the casing 111 along a vertical direction of the air inlet 112. An air outlet 113 configured to blow off the air sucked from the air inlet 112 indoors is formed in the upper portion of the front surface of the casing 111, that is, in a position higher than the air inlet 112 (for example, above the center portion of the casing 111 along the vertical direction). The operation unit 26 is provided to the front surface of the casing 111 above the air inlet 112 and below the air outlet 113. The operation unit 26 is connected to the controller 30 through a communication line, and is capable of conducting mutual data communications to/from the controller 30. In the operation unit 26, an operation-start manipulation, an operation-end manipulation, switching of an operation mode, setting of a set temperature and a set airflow rate, and other operations are conducted for the air-conditioning apparatus based on user's manipulations. The operation unit 26 includes a display unit or an audio output unit as an informing unit configured to inform the user of information.

The casing 111 is a hollow box body, and the inside of the box body is an air passage. A front opening part is formed on a front surface of the casing 111. The casing 111 includes a first front panel 114*a*, a second front panel 114*b*, and a third front panel 114*c*, which are removably mounted to the front opening part. The first front panel 114*a*, the second front panel 114*b*, and the third front panel 114*c* all have a substantially rectangular flat outer shape. The first front panel 114*a* is removably mounted to a lower part of the front opening part of the casing 111. In the first front panel 114*a*, the air inlet 112 described above is formed. The second front panel 114*b* is arranged above the first front panel 114*a* such that they are adjacent to each other, and is removably mounted to a center part of the front opening part of the casing 111 along the vertical direction. In the second front panel 114*b*, the operation unit 26 described above is provided. The third front panel 114*c* is arranged above the second front panel 114*b* such that they are adjacent to each other, and is removably mounted to an upper part of the front opening part of the casing 111. In the third front panel 114*c*, the air outlet 113 described above is formed.

An internal space of the casing 111 is roughly divided into a space 115*a* being an air-sending part and a space 115*b* being a heat-exchanging part located above the space 115*a*. The space 115*a* and the space 115*b* are partitioned by a partition portion 20. The partition portion 20 has, for example, a flat shape, and is arranged approximately horizontally. In the partition portion 20, at least an air passage opening part 20*a* is formed to serve as an air passage between the space 115*a* and the space 115*b*. The space 115*a* is exposed to the front surface side when the first front panel 114*a* is removed from the casing 111, and the space 115*b* is exposed to the front surface side when the second front panel 114*b* and the third front panel 114*c* are removed from the casing 111. That is, the partition portion 20 is mounted at approximately the same height as a height of an upper edge of the first front panel 114*a* or a lower edge of the second front panel 114*b*. In this case, the partition portion 20 may be formed integrally with a fan casing 108 to be described later, may be formed integrally with a drain pan to be described later, or may be formed separately from the fan casing 108 or the drain pan.

In the space 115*a*, the indoor air-sending fan 7*f*, which is configured to cause a flow of air from the air inlet 112 to the air outlet 113 in the air passage 81 of the casing 111, is arranged. The indoor air-sending fan 7*f* in this embodiment is a sirocco fan including a motor (not shown) and an impeller 107, which is connected to an output shaft of the motor and has a plurality of blades arranged, for example, at regular intervals along its circumferential direction. A rotary shaft of the impeller 107 is arranged substantially in parallel with a front-and-back direction of the casing 111. The rotation speed of the indoor air-sending fan 7*f* is controlled by the controller 30 based on a set airflow rate or other conditions set by the user so as to be variably set at multiple stages (for example, two stages or more) or continuously.

The impeller 107 of the indoor air-sending fan 7*f* is covered with the fan casing 108 having a spiral shape. The fan casing 108 is formed, for example, separately from the casing 111. A suction opening part 108*b* for sucking the indoor air through the air inlet 112 into the fan casing 108 is formed near the center of a spiral of the fan casing 108. The suction opening part 108*b* is located so as to be opposed to the air inlet 112. Further, an air outlet opening part 108*a* for blowing off the sent air is formed along a direction of a tangential line of the spiral of the fan casing 108. The air outlet opening part 108*a* is located so as to be directed upward, and is connected to the space 115*b* through the air passage opening part 20*a* of the partition portion 20. In other words, the air outlet opening part 108*a* communicates with the space 115*b* through the air passage opening part 20*a*. An opening end of the air outlet opening part 108*a* and an opening end of the air passage opening part 20*a* may be directly linked to each other, or may be indirectly linked to each other through a duct member or other members.

Further, in the space 115*a*, there is provided an electric component box 25 accommodating, for example, a microcomputer that forms the controller 30, various types of electrical components, and a substrate.

The load-side heat exchanger 7 is arranged in the air passage 81 within the space 115*b*. The drain pan (not shown) configured to receive condensed water that is condensed on a surface of the load-side heat exchanger 7 is provided below the load-side heat exchanger 7. The drain pan may be formed as a part of the partition portion 20, or may be formed separately from the partition portion 20 to be arranged on the partition portion 20. In this embodiment, there is described an example in which the load-side heat exchanger 7 is provided above the indoor air-sending fan 7*f*. However, the present invention is not limited to this configuration. The top-bottom relationship of the load-side heat exchanger 7 and the indoor air-sending fan 7*f* may be reversed. Alternatively, the load-side heat exchanger 7 and the indoor air-sending fan 7*f* may be arranged side by side.

The refrigerant detection unit 99 is provided at a position closer to the bottom of the space 115*a*. The refrigerant has a density larger than that of air under an atmospheric pressure, and hence the refrigerant detection unit 99 is desired to be provided at a lower position inside the casing 111. Further, as described later, the refrigerant detection unit 99 is desired to be at a position lower than the position at which the refrigerant may leak (for example, a brazed portion of the load-side heat exchanger 7 and the joint portions 15*a* and 15*b*), and hence is desired to be provided in the lowermost position (bottom portion) of the casing 111. In this embodiment, the refrigerant detection unit 99 is provided at a position closer to the bottom of the space 115*a*, but the refrigerant detection unit 99 may be provided at another position. As the refrigerant detection unit 99, a gas sensor, for example, a semiconductor gas sensor or a hot-wire type semiconductor gas sensor, is used. The refrigerant detection unit 99 detects, for example, a refrigerant concentration within the air around the refrigerant detection unit 99, and outputs a detection signal to the controller 30. The controller 30 determines occurrance of leakage of the refrigerant based on the detection signal received from the refrigerant detection unit 99.

Further, as the refrigerant detection unit 99, an oxygen concentration meter or a temperature sensor (for example, thermistor) may be used. When the temperature sensor is used as the refrigerant detection unit 99, the refrigerant detection unit 99 detects temperature drop of the refrigerant that has leaked due to adiabatic expansion, to thereby detect the leakage of the refrigerant. Further, when the refrigerant leaks, the refrigerant detection unit 99 detects the refrigerant, and the controller 30 causes the indoor air-sending fan 7*f* to forcedly operate. At this time, all of the portions at which the refrigerant may leak are arranged inside the air passage. In addition, the refrigerant detection unit 99 is arranged inside the air passage and lower than the portions at which the refrigerant may leak. Therefore, when the refrigerant leaks, the refrigerant that has leaked can be detected by the refrigerant detection unit 99 before the refrigerant that has leaked flows out of the casing 111 of the indoor unit 1. The forced operation of the indoor air-sending fan 7*f* is continued for a time period (for example, 10 hours) set in advance based on the amount of the sealed refrigerant in the air-conditioning apparatus.

Next, description is given of an operation performed to operate or stop the indoor air-sending fan 7*f* when inspection and repair of leakage of the refrigerant is performed. As methods of operating or stopping the indoor air-sending fan 7*f*, there are given, as a first method, a method of operating or stopping the indoor air-sending fan 7*f* by turning on or off a main power source (breaker), and, as a second method, a method of stopping or starting (restarting) the forced operation of the indoor air-sending fan 7*f* by a special manipulation on the operation unit 26.

First, description is given on the first method, that is, the method of operating or stopping the indoor air-sending fan 7*f* by turning on or off the main power source (breaker). The indoor air-sending fan 7*f* is supplied with power from the main power source (breaker), and thus the indoor air-sending fan 7*f* is stopped when the main power source (breaker) is turned off, and the operation of the indoor air-sending fan 7*f* is started (restarted) when the main power source (breaker) is turned on. When the inspection and repair of the air-conditioning apparatus is performed by a service person, the main power source (breaker) is turned off or on to stop or operate the indoor air-sending fan 7*f* so that the safety of the work is secured.

Next, description is given of the second method, that is, the method of stopping or starting (restarting) the forced operation of the indoor air-sending fan 7*f* by means of the special manipulation on the operation unit 26.

The controller 30 is configured to execute, as operation modes of the indoor air-sending fan 7*f*, a first operation mode, in which a normal air-sending operation is performed, and a second operation mode, in which a forced operation is performed when the refrigerant leaks. The first operation mode is executed based on, as a first manipulation, an operation of starting the normal operation of the indoor air-sending fan 7*f* performed on the operation unit 26, and, as a second manipulation, an operation of stopping the normal operation of the indoor air-sending fan 7*f* performed on the operation unit 26. Meanwhile, the second operation mode is the following operation mode. That is, the operation of the indoor air-sending fan 7*f* is started when leakage of the refrigerant is detected by the refrigerant detection unit 99, and the indoor air-sending fan 7*f* is forcedly stopped based on a third manipulation different from the second manipulation without being stopped based on the above-mentioned second manipulation. Then, the forced operation of the indoor air-sending fan 7*f* is restarted based on a fourth manipulation different from the first manipulation.

Now, description is given on the above-mentioned third manipulation and fourth manipulation. The third manipulation and fourth manipulation differ from the normal first manipulation and second manipulation, which are performed by the user via the operation unit 26 on the air-conditioning apparatus. The third manipulation and fourth manipulation are so-called special manipulations used when the service person performs the inspection and repair of the air-conditioning apparatus. In this embodiment, the state in which the normal first manipulation and second manipulation, which are performed by the user or another person via the operation unit 26, are received can be switched to the state in which the third manipulation and fourth manipulation, which are the special manipulations, are received only by a method that can only be performed by a professional service person. With this, it is possible to prevent the user from stopping the indoor air-sending fan 7*f* on his or her own judgment although the refrigerant is leaking. As a method of switching the state in which the normal first manipulation and second manipulation are received in the first operation mode to the state in which the third manipulation and fourth manipulation are received in the second operation mode, there is given, for example, a method of performing a special manipulation on the operation unit 26 (including a remote controller 26B).

Further, as another example of the special manipulation on the operation unit 26 (including a remote controller 26B), there is given use of a dedicated checker to be used by the service person. Also with this operation, similarly, it is possible to prevent the user from stopping the indoor air-sending fan 7*f* at a time of leakage of the refrigerant.

In general, when leakage of the refrigerant is checked for, a window or a door is opened so that ventilation is secured. Then, the main power source (breaker) is turned off so that the safety is secured. When the main power source (breaker) is turned off, the forced operation of the indoor air-sending fan 7*f* is also stopped, but during the work of the inspection and repair performed by the service person, the service person is also on site and the ventilation is also secured, and hence no problems occur. Meanwhile, the details of a repair required for restoration of the air-conditioning apparatus depend on individual type of failure, and hence, as a result of the inspection, replacement parts that are usually brought by the service person may not be sufficient in some cases. In such a case, the service person may be required to temporarily leave the site in order to obtain necessary replacement parts at a service center or another place after taking temporary measures. At this time, the window or the door may be required to be closed (locked) for security reasons, and thus, when the indoor air-sending fan 7*f* is kept stopped, a flammable concentration region (for example, region in which the refrigerant concentration is equal to or larger than the lower flammability limit (LFL)) may be formed in the indoor space. This case corresponds to, for example, a case in which the repair to suppress the leakage of the refrigerant is not finished with the temporary measures and there is a possibility that the leakage of the refrigerant continues. Even in such a case, when the forced operation of the indoor air-sending fan 7*f* is restarted, it is possible to prevent the refrigerant concentration of the refrigerant that has leaked from being locally increased.

As described above, there are the first method and the second method, and with the second method, it is possible to stop the forced operation of the indoor air-sending fan 7*f* by means of the special manipulation on the operation unit 26. Therefore, under a state in which the safety is secured during the inspection and repair, the main power source (breaker) is not required to be turned on or off. That is, it is not required to frequently check the main power source (breaker), which is generally provided at a position distant from the installation position of the indoor unit, and thus an effect that the workability of the service person can also be improved can be obtained. As a matter of course, the service person being a professional operator is responsible for (is in a position to be responsible for) securing the safety and securing the ventilation, that is, taking a measure for preventing the flammable concentration region from being formed in the indoor space, until the inspection and repair is finished. For that reason, there is no problem even when the service person is enabled to stop or start (restart) the forced operation of the indoor air-sending fan 7*f*.

Figure 5:
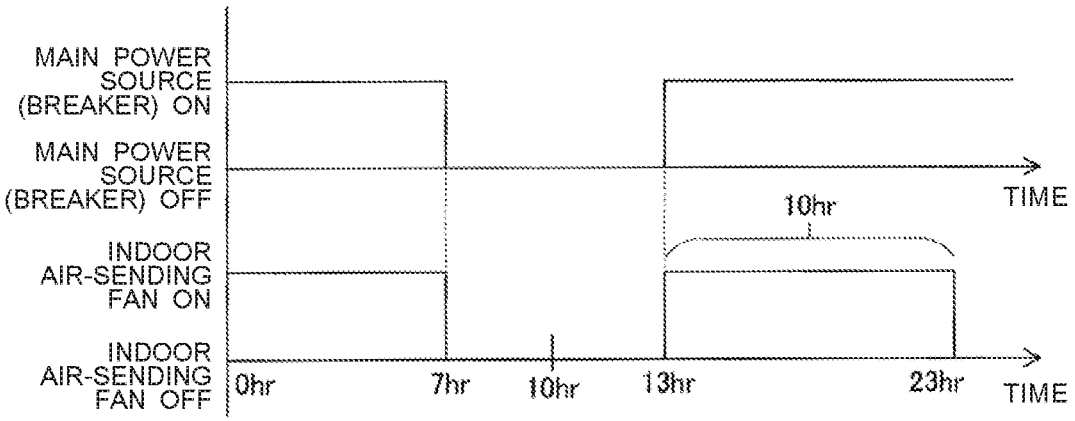
FIG. 5 is a time chart for illustrating a relationship between an operation of a main power source (breaker) of the air-conditioning apparatus and a forced operation (second operation mode) of an indoor air-sending fan 7*f* in the embodiment of the present invention.
Figure 6:
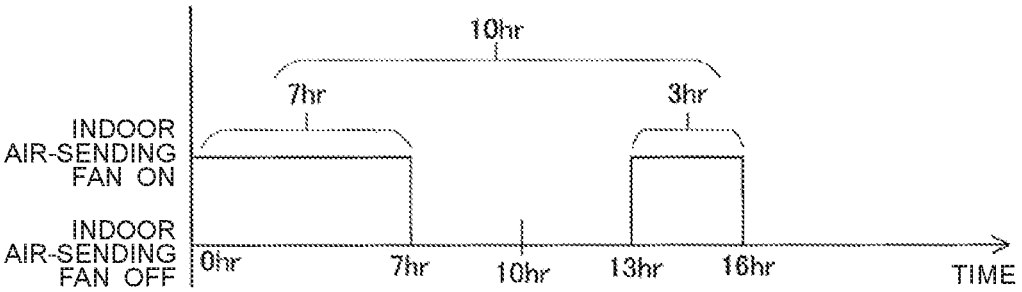
FIG. 6 is a time chart for illustrating a state of the forced operation (second operation mode) of the indoor air-sending fan 7*f* in a case where a special manipulation of the air-conditioning apparatus is performed in the embodiment of the present invention.

FIG. 5 is a time chart for illustrating a relationship between an operation of the main power source (breaker) of the air-conditioning apparatus and the forced operation (second operation mode) of the indoor air-sending fan 7*f* in the embodiment of the present invention. Further, FIG. 6 is a time chart for illustrating the state of the forced operation (second operation mode) of the indoor air-sending fan 7*f* in a case where the special manipulation of the air-conditioning apparatus is performed in the embodiment of the present invention. When leakage of the refrigerant is detected, in order not to allow the flammable concentration region to be formed in the indoor space, the indoor air-sending fan 7*f* is forcedly operated until the operation time thereof reaches a reference time (for example, 10 hours) set in advance. There are two methods of operating the indoor air-sending fan 7*f* until the operation time thereof reaches the reference time. The first method involves continuing repeatedly operating the indoor air-sending fan 7*f* until the continuous operation time thereof reaches the reference time. This first operation method is used when the indoor air-sending fan 7*f* is operated or stopped based on the operation of turning on or off the main power source (breaker) in the above-mentioned first method. Further, the second method involves continuing operating the indoor air-sending fan 7*f* until the integrated operation time thereof reaches the reference time. This second operation method is used when the forced operation of the indoor air-sending fan 7*f* is stopped or started (restarted) by means of the special manipulation on the operation unit 26 in the above-mentioned second method.

As illustrated in FIG. 5, in a case where the time period (reference time) of the forced operation of the indoor air-sending fan 7*f* is set to 10 hours, when leakage of the refrigerant is detected with no time having elapsed, the indoor air-sending fan 7*f* is automatically started to forcedly operate because the main power source (breaker) is turned on. However, for example, when the main power source (breaker) is turned off when 7 hours, which are less than 10 hours being the reference time, have elapsed, the indoor air-sending fan 7*f* is stopped operating at the same time. In this case, the continuous operation time of the indoor air-sending fan 7*f* is less than 10 hours being the reference time, and hence, when the main power source (breaker) is turned on thereafter, the controller 30 causes the indoor air-sending fan 7*f* to start to operate again. For example, as illustrated in FIG. 5, with the indoor air-sending fan 7*f* being operated from a point of time when 13 hours have elapsed to a point of time when 23 hours have elapsed, a continuous operation of the indoor air-sending fan 7*f* is performed up to 10 hours being the reference time, and thus the forced operation can be ended. In this manner, a longer time period of the forced operation of the indoor air-sending fan 7*f* can be secured. As a matter of course, the above-mentioned time and the time indicated in FIG. 5 are merely examples, and the present invention is not limited to the time exemplified above.

Next, description is given on a case in which the service person stops, by means of the special manipulation, the indoor air-sending fan 7*f* at the time when, for example, 7 hours have elapsed from the time at which leakage of the refrigerant was detected, and starts (restarts) the operation of the indoor air-sending fan 7*f* at the time when, for example, 13 hours have elapsed from the time at which the leakage of the refrigerant was detected. As illustrated in FIG. 6, in a case where the time period (reference time) of the forced operation of the indoor air-sending fan 7*f* is set to 10 hours, and leakage of the refrigerant is detected when 0 hours have elapsed, the indoor air-sending fan 7*f* is forcedly operated automatically. At the time when the operation time of the indoor air-sending fan 7*f* has reached 7 hours, the fact that the integrated operation time of the indoor air-sending fan 7*f* is 7 hours is stored in the clock unit 30*a*. After that, the service person stops the indoor air-sending fan 7*f* at the time when 7 hours have elapsed by means of the special manipulation. Then, at the time when 13 hours have elapsed, the service person starts (restarts) the operation of the indoor air-sending fan 7*f* by means of the special manipulation. When the operation time of the indoor air-sending fan 7*f* after the restart of the operation has reached 3 hours (i.e. when 16 hours have elapsed), the fact that the integrated operation time of the indoor air-sending fan 7*f* that is obtained by adding thereto an operation time of 3 hours from a point of time when 13 hours have elapsed to a point of time when 16 hours have elapsed is 10 hours is stored in the clock unit 30*a*. Then, based on the fact that the integrated operation time of the indoor air-sending fan 7*f* has reached 10 hours being the reference time, the indoor air-sending fan 7*f* is stopped. As described above, when the operation of the indoor air-sending fan 7*f* is stopped and started (restarted) by means of the special manipulation, the controller 30 causes the clock unit 30*a* to integrate the operation time of the indoor air-sending fan 7*f*, and determines whether or not the integrated operation time has reached the reference time. Then, when the integrated operation time has reached the reference time, the controller 30 stops the operation of the indoor air-sending fan 7*f*. In this manner, it is possible to execute the forced operation of the indoor air-sending fan 7*f* for the time period set in advance based on the amount of the sealed refrigerant in the air-conditioning apparatus. As a matter of course, the above-mentioned time and the time indicated in FIG. 6 are merely examples, and the present invention is not limited to the time exemplified above.

Figure 7:
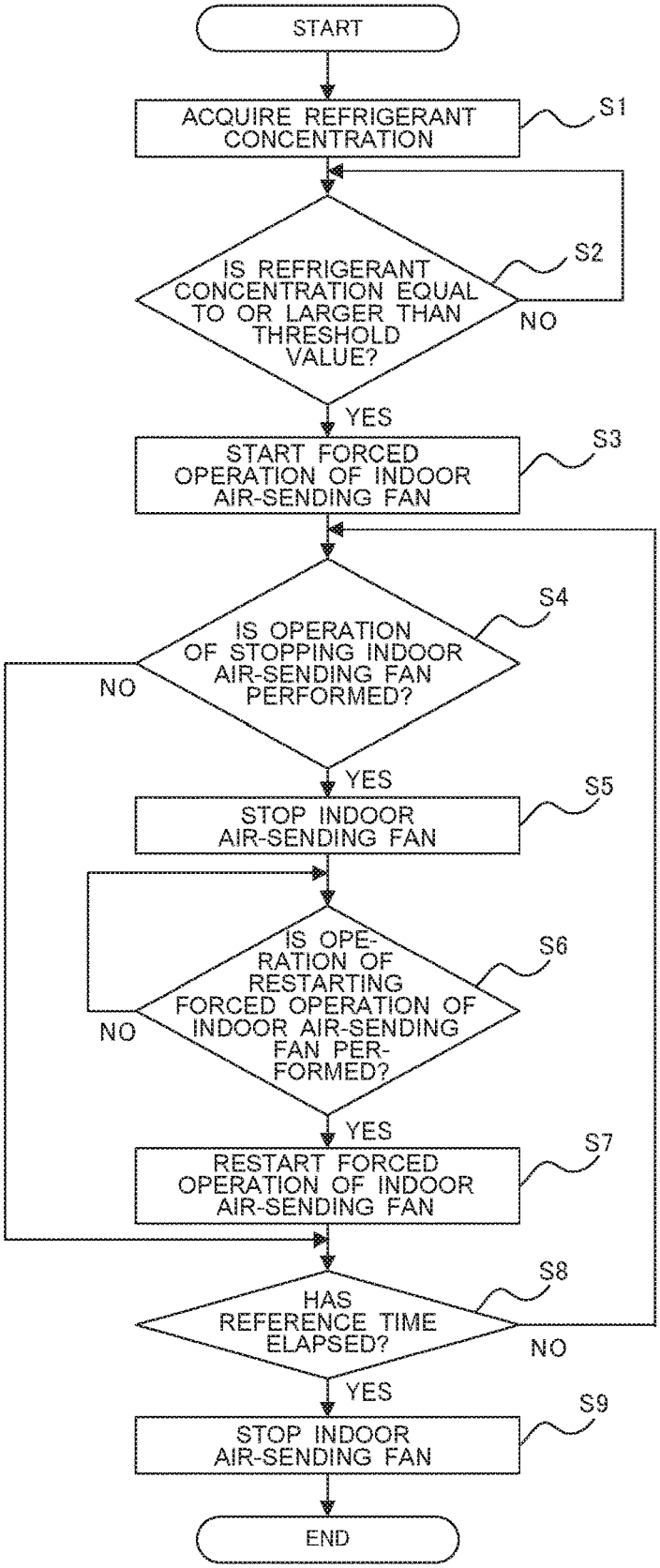
FIG. 7 is a flow chart for illustrating an example of refrigerant leakage detection processing executed by a controller 30 of the air-conditioning apparatus in the embodiment of the present invention.

FIG. 7 is a flow chart for illustrating an example of the flow of refrigerant leakage detection processing executed by the controller 30 of the air-conditioning apparatus in the embodiment of the present invention. The refrigerant leakage detection processing is executed repeatedly at all times including a period in which the air-conditioning apparatus is operating and is stopped.

In Step S1 of FIG. 7, the controller 30 acquires information on the refrigerant concentration around the refrigerant detection unit 99 based on the detection signal received from the refrigerant detection unit 99.

Next, in Step S2, it is determined whether or not the refrigerant concentration around the refrigerant detection unit 99 is equal to or larger than a threshold value set in advance. When it is determined that the refrigerant concentration is equal to or larger than the threshold value, the processing proceeds to Step S3, and when the refrigerant concentration is smaller than the threshold value, the processing of Step S2 is repeatedly performed.

In Step S3, the forced operation (second operation mode) of the indoor air-sending fan 7*f* is started. When the indoor air-sending fan 7*f* is already operating, the operation is continued as it is. Further, in Step S3, the rotation speed of the indoor air-sending fan 7*f* may be set to a rotation speed at which the refrigerant can be sufficiently diffused even when the refrigerant leakage amount is at the maximum. The rotation speed is not limited to the rotation speed used during the normal operation. In Step S3, the informing unit (for example, display unit or audio output unit) provided in the operation unit 26 may be used to inform the user that leakage of the refrigerant has occurred.

In Step S4, it is determined whether or not a manipulation (third manipulation of the second operation mode) of stopping the indoor air-sending fan 7*f* is performed as the special manipulation. When the manipulation of stopping the indoor air-sending fan 7*f* is performed as the special manipulation, the processing proceeds to Step S5, and when the manipulation of stopping the indoor air-sending fan 7*f* is not performed as the special manipulation, the processing proceeds to Step S8.

In Step S5, the indoor air-sending fan 7*f* is stopped. Then, the processing proceeds to Step S6.

In Step S6, it is determined whether or not a manipulation (fourth manipulation of the second operation mode) of restarting the operation of the indoor air-sending fan 7*f* is performed as the special manipulation. When the manipulation of restarting the operation of the indoor air-sending fan 7*f* is performed as the special manipulation, the processing proceeds to Step S7, and when the manipulation of restarting the operation of the indoor air-sending fan 7*f* is not performed as the special manipulation, the processing of Step S6 is repeatedly performed.

In Step S7, the operation of the indoor air-sending fan 7*f* is restarted. Then, the processing proceeds to Step S8.

In Step S8, it is determined whether or not the integrated operation time of the indoor air-sending fan 7*f* has exceeded the reference time (for example, 10 hours). When the integrated operation time of the indoor air-sending fan 7*f* has exceeded the reference time, the processing proceeds to Step S9, and when the integrated operation time of the indoor air-sending fan 7*f* has not exceeded the reference time yet, the processing proceeds to Step S4.

In Step S9, the indoor air-sending fan 7*f* is stopped.

As described above, in the refrigerant leakage detection processing, when the leakage of the refrigerant is detected (that is, when the refrigerant concentration detected by the refrigerant detection unit 99 is equal to or larger than the threshold value), the indoor air-sending fan 7*f* is started to operate. With this operation, it is possible to diffuse the refrigerant that has leaked, and thus it is possible to inhibit the refrigerant concentration from increasing locally in the indoor space.

As described above, in this embodiment, examples of the refrigerant to be circulated by the refrigerant circuit 40 include flammable refrigerants such as HFO-1234yf, HFO-1234ze, R290, and R1270. Therefore, if leakage of refrigerant occurs in the indoor unit 1, there is a fear that the indoor refrigerant concentration is increased to form a flammable concentration region.

Those flammable refrigerants have a density larger than that of air under the atmospheric pressure. Therefore, when the leakage of the refrigerant occurs at a position at which the height from the floor surface of the indoor space is relatively high, the refrigerant that has leaked is diffused while descending. Thus, the refrigerant concentration becomes uniform in the indoor space, and hence the refrigerant concentration is less liable to be increased. In contrast, when the leakage of the refrigerant occurs at a position at which the height from the floor surface of the indoor space is low, the refrigerant that has leaked remains at a low position near the floor surface, and hence the refrigerant concentration tends to be locally increased. As a result, the risk of the formation of the flammable concentration region is relatively increased.

During a period in which the air-conditioning apparatus is operated, air is blown off to the indoor space due to the operation (first operation mode) of the indoor air-sending fan 7*f* of the indoor unit 1. Therefore, even if the flammable refrigerant leaks to the indoor space, the flammable refrigerant that has leaked is diffused in the indoor space by the air being blown off. In this manner, it is possible to inhibit the flammable concentration region from being formed in the indoor space. However, during the period in which the air-conditioning apparatus is stopped, the indoor air-sending fan 7*f* of the indoor unit 1 is also stopped, and hence the refrigerant that has leaked cannot be diffused by the air being blown off. Therefore, detection of the refrigerant that has leaked is more required during the period in which the air-conditioning apparatus is stopped. In this embodiment, the forced operation (second operation mode) of the indoor air-sending fan 7*f* is started when the leakage of the refrigerant is detected, and hence it is possible to inhibit the flammable concentration region from being formed in the indoor space even when the flammable refrigerant leaks to the indoor space during the period in which the air-conditioning apparatus is stopped.

Other Embodiments

The present invention is not limited to the above-mentioned embodiment, and various modifications may be made thereto. For example, in the above-mentioned embodiment, the indoor unit 1 is exemplified, but the present invention can also be applied to an outdoor unit. Further, in the above-mentioned embodiment, description is given of the air-conditioning apparatus as an example. However, the present invention can also be applied to other refrigeration cycle apparatuses or other refrigeration cycle systems such as a heat pump water heater, a chiller, and a showcase.

Advantageous Effects of Embodiment

From the above description, according to this embodiment, there is provided the refrigeration cycle apparatus including: the refrigerant circuit 40 configured to circulate the refrigerant; the indoor unit 1 configured to accommodate at least the load-side heat exchanger 7 of the refrigerant circuit 40; the controller 30 configured to control the indoor unit 1; and the operation unit 26 configured to receive manipulations on the indoor unit 1. The indoor unit 1 includes the refrigerant detection unit 99 and the indoor air-sending fan 7*f*. The controller 30 is configured to execute the first operation mode and the second operation mode as the operation modes of the indoor air-sending fan 7*f*. The first operation mode is an operation mode in which the operation of the indoor air-sending fan 7*f* is started based on the first manipulation performed on the operation unit 26 and the indoor air-sending fan 7*f* is stopped based on the second manipulation performed on the operation unit 26. The second operation mode is an operation mode in which the operation of the indoor air-sending fan 7*f* is started when the refrigerant is detected by the refrigerant detection unit 99, the indoor air-sending fan 7*f* is not stopped based on the second manipulation, the indoor air-sending fan 7*f* is stopped based on the third manipulation different from the second manipulation, and the operation of the indoor air-sending fan 7*f* is restarted based on the fourth manipulation different from the first manipulation.

In this manner, even when the flammable refrigerant leaks, the controller 30 executes the second operation mode so that the forced operation of the indoor air-sending fan 7*f* is started, and hence it is possible to inhibit the flammable concentration region from being formed locally. Further, in the second operation mode, the indoor air-sending fan 7*f* is not stopped based on the second manipulation for stopping the normal operation (first operation mode). Therefore, it is possible to prevent a user or another person who does not know the cause of leakage and how the inspection and repair was performed from stopping the indoor air-sending fan 7*f* in the forced operation on his or her own judgment. Consequently, it is possible to prevent the flammable concentration region from being formed locally. Further, in the second operation mode, the indoor air-sending fan 7*f* is stopped based on the third manipulation different from the second manipulation. Therefore, when a service person begins the inspection and repair of the air-conditioning apparatus, it is possible to secure the safety during the inspection and repair by stopping the indoor air-sending fan 7*f* in the forced operation. Further, in the second operation mode, the operation of the indoor air-sending fan 7*f* is restarted based on the fourth manipulation different from the first manipulation for starting the normal operation. Therefore, at the time when the service person leaves the site of the inspection and repair, it is possible to inhibit the flammable concentration region from being formed locally by restarting the forced operation of the indoor air-sending fan 7*f*.

Further, it is preferred that the controller 30 include the clock unit 30*a* configured to clock the operation time of the indoor air-sending fan 7*f* in the second operation mode, and that the controller 30 be configured to execute the second operation mode until the continuous operation time reaches the reference time.

Further, it is preferred that the controller 30 include the clock unit 30*a* configured to clock the operation time of the indoor air-sending fan 7*f* in the second operation mode, and that the controller 30 be configured to execute the second operation mode until the integrated operation time reaches the reference time.

In this manner, the indoor air-sending fan 7*f* is operated until the continuous or integrated operation time of the indoor air-sending fan 7*f* reaches the reference time. Consequently, even when the flammable refrigerant leaks, the refrigerant that has leaked is sufficiently stirred, and hence it is possible to inhibit the flammable concentration region from being formed locally.

REFERENCE SIGNS LIST

1 indoor unit 2 outdoor unit 3 compressor 4 refrigerant flow switching device 5 heat source-side heat exchanger 5*f* outdoor air-sending fan 6 pressure reducing device 7 load-side heat exchanger 7*f* indoor air-sending fan 9*a* indoor pipe 9*b* indoor pipe 10*a* extension pipe 10*b* extension pipe 11 suction pipe 12 discharge pipe 13*a* extension pipe connecting valve 13*b* extension pipe connecting valve 14*a* service port 14*b* service port 14*c* service port 15*a* joint portion 15*b* joint portion 20 partition portion 20*a* air passage opening part 25 electric component box 26 operation unit 30 controller 30*a* clock unit 40 refrigerant circuit 81 air passage 91 suction air temperature sensor 92 heat exchanger entrance temperature sensor 93 heat exchanger temperature sensor 99 refrigerant detection unit 107 impeller 108 fan casing 108*a* air outlet opening part 108*b* suction opening part 111 casing 112 air inlet 113 air outlet 114*a* first front panel 114*b* second front panel 114*c* third front panel 115*a* space 115*b* space

The invention claimed is:

1. A refrigeration cycle apparatus, comprising:

a refrigerant circuit configured to circulate refrigerant;

an indoor unit accommodating at least a load-side heat exchanger of the refrigerant circuit;

a controller configured to control the indoor unit; and a control panel configured to receive a manipulation on the indoor unit, the indoor unit including:

a refrigerant detector; and an air-sending fan, the controller being configured to cause a first operation mode and a second operation mode as operation modes of the air-sending fan to be executed, the first operation mode being a normal operation mode in which an operation of the air-sending fan is started based on an operation-start manipulation performed on the control panel and the air-sending fan is stopped based on an operation-stop manipulation performed on the control panel, the second operation mode being a forced-exhaust operation mode in which the operation of the air-sending fan is started when refrigerant is detected by the refrigerant detector, the air-sending fan is prevented from being stopped based on the operation-stop manipulation, the air-sending fan is stopped based on an exhaust-stop manipulation different from the operation-stop manipulation and performed on the control panel, and the operation of the air-sending fan is restarted based on an exhaust-resume manipulation different from the operation-start manipulation and performed on the control panel.

2. The refrigeration cycle apparatus of claim 1, wherein the controller is configured to clock an operation time of the air-sending fan in the second operation mode and integrate a total operation time of the second operation mode into an integrated operation time, and wherein the controller is configured to execute the second operation mode until the integrated operation time reaches a reference time.

3. The refrigeration cycle apparatus of claim 1, wherein the indoor unit is a floor-type indoor unit.

4. The refrigeration cycle apparatus of claim 1, wherein the refrigerant includes a flammable refrigerant.

5. The refrigeration cycle apparatus of claim 2, wherein the controller is further configured to execute the second operation mode until a continuous operation time reaches the reference time.

6. A refrigeration cycle apparatus, comprising:

a refrigerant circuit configured to circulate refrigerant;

an indoor unit accommodating at least a load-side heat exchanger of the refrigerant circuit;

a controller configured to control the indoor unit; and a control panel configured to receive a manipulation on the indoor unit, the indoor unit including:

a refrigerant detector; and an air-sending fan, the controller being configured to cause a first operation mode and a second operation mode to be executed as operation modes of the air-sending fan, the first operation mode being a normal operation mode in which an operation of the air-sending fan is started based on an operation-start manipulation performed on the control panel and the air-sending fan is stopped based on an operation-stop manipulation performed on an another control panel, the second operation mode being a forced-exhaust operation mode in which the operation of the air-sending fan is started when refrigerant is detected by the refrigerant detector, the air-sending fan is prevented from being stopped based on the operation-stop manipulation, the air-sending fan is stopped based on an exhaust-stop manipulation different from the operation-stop manipulation, and the operation of the air-sending fan is restarted based on an exhaust-resume manipulation different from the operation-start manipulation, and the operation-stop manipulation and the exhaust-stop manipulation being manipulations that are performed based on a manipulation on the another control panel that is different from the control panel of the refrigeration cycle apparatus.

7. The refrigeration cycle apparatus of claim 6, wherein the controller is configured to clock an operation time of the air-sending fan in the second operation mode and integrate a total operation time of the second operation mode into an integrated operation time, and wherein the controller is configured to execute the second operation mode until the integrated operation time reaches a reference time.

8. The refrigeration cycle apparatus of claim 6, wherein the indoor unit is a floor-type indoor unit.

9. The refrigeration cycle apparatus of claim 6, wherein the refrigerant includes a flammable refrigerant.

10. The refrigeration cycle apparatus of claim 7, wherein the controller is further configured to execute the second operation mode until a continuous operation time reaches the reference time.

* * * * *